US005801744A

United States Patent [19]

Taniguchi et al.

[11] Patent Number: 5,801,744

[45] Date of Patent: Sep. 1, 1998

[54] THERMAL PRINTER

[75] Inventors: Jun Taniguchi; Masahiko Mori; Yasuhiko Iwane, all of Iwate-ken, Japan

[73] Assignee: Alps Electric Co., Ltd., Japan

[21] Appl. No.: 594,931

[22] Filed: Jan. 31, 1996

[30] Foreign Application Priority Data

Feb. 3, 1995 [JP] Japan ..... 7-017199
Jul. 26, 1995 [JP] Japan ..... 7-190421

[51] Int. Cl.[6] ..... B41J 2/32; B41J 25/304

[52] U.S. Cl. ..... 347/218; 347/197

[58] Field of Search ..... 400/185, 186, 400/187, 120.16; 347/197, 215, 218

[56] References Cited

U.S. PATENT DOCUMENTS

| | | | |
|---|---|---|---|
| 4,401,391 | 8/1983 | Kawai et al. | 347/197 |
| 4,420,763 | 12/1983 | Cuel et al. | 347/197 |
| 4,444,521 | 4/1984 | Rickard et al. | 347/197 |
| 4,475,825 | 10/1984 | Hashimoto | 347/197 |
| 4,644,371 | 2/1987 | Matsuura et al. | 347/197 |
| 4,654,673 | 3/1987 | Yanata et al. | 347/197 |
| 4,752,786 | 6/1988 | Inoue et al. | 347/197 |
| 5,008,684 | 4/1991 | Kurafuji | 347/197 |

*Primary Examiner*—Huan H. Tran
*Attorney, Agent, or Firm*—Brinks Hofer Gilson & Lione

[57] ABSTRACT

A thermal printer is provided which is capable of easily controlling the operations of a carriage and conveyance rollers by only one drive motor thereof and which enables the size and cost to be reduced. A thermal printer including a carriage capable of reciprocatively moving along a platen when a carriage drive shaft is rotated; a thermal head provided for the carriage to oppose the platen; an urging member for urging the thermal head to the platen; a cam portion for separating the thermal head from the platen against the urging force of the urging member when the thermal head has passed a printable range as a result of movement of the carriage; conveyance rollers to be rotated when a roller drive shaft is rotated and arranged to convey a recording medium; a drive motor for rotating the carriage drive shaft and the roller drive shaft; and drive-force transmission device which always transmits the drive force of the drive motor to the carriage drive shaft and which transmits the drive force of the drive motor to the roller drive shaft only when the carriage is moved in either direction and when the thermal head has passed the printable range.

3 Claims, 12 Drawing Sheets

THERMAL PRINTER

BACKGROUND OF THE INVENTION

1. Field of the Invention

The present invention relates to a thermal printer including a thermal head to print characters on a recording medium, such as thermal printing paper, and more particularly to a thermal printer for use preferably in, for example, a recording-type electronic desk calculator or an electronic cash register.

2. Related Background Art

In general, a small size thermal printer, having a thermal head for directly printing characters on a recording medium, has been employed in a recording-type electronic desk calculator and an electronic cash register (an ECR).

A conventional thermal printer of the foregoing type includes a thermal head mounted on a carriage thereof, the thermal head having a plurality of aligned heating devices. The thermal head is pressed against a platen through a recording medium, such as thermal recording paper. In the foregoing state of pressurization, the heating devices aligned on the thermal head are caused to selectively generate heat in accordance with information about printing while the carriage being moved along the platen. Thus, an image, such as desired characters, are printed on the recording medium. Then, conveyance rollers are rotated whenever an image for one line is printed so as to convey (move) the recording medium. Thus, an operation for forwards moving the recording medium for a predetermined distance is performed to print the next line.

In recent years reduction in the size and that in the cost of the recording-type desk calculator and the ECR have been intended without exception. Similarly to the foregoing products, reduction in the size and that in the cost of the thermal printers have been intended.

However, the conventional thermal printer includes a motor for moving the carriage and a motor for rotating the conveyance rollers for conveying (moving) the recording medium for a predetermined distance to print a new line such that the two motors are provided individually. The foregoing structure encounters a problem in that the recent requirement for reducing the size and cost cannot be satisfied. Another problem arises in that control of the operations of the two motors becomes too difficult.

SUMMARY OF THE INVENTION

In view of the foregoing, an object of the present invention is to provide a thermal printer capable of easily controlling the operation of a carriage and those of conveyance rollers by one drive motor thereof and enabling the size and cost to be reduced.

According to one aspect of the present invention, as claimed in claim 1, there is provided a thermal printer comprising: a carriage capable of reciprocatively moving along a platen when a carriage drive shaft is rotated; a thermal head provided for the carriage to oppose the platen; an urging member for urging the thermal head to the platen; a cam portion for separating the thermal head from the platen against the urging force of the urging member when the thermal head has passed a printable range as a result of movement of the carriage; conveyance rollers to be rotated when a roller drive shaft is rotated and arranged to convey a recording medium; a drive motor for rotating the carriage drive shaft and the roller drive shaft; and drive-force transmission means which always transmits the drive force of the drive motor to the carriage drive shaft and which transmits the drive force of the drive motor to the roller drive shaft only when the carriage is moved in either direction and when the thermal head has passed the printable range.

As a result of the structure above, only one drive motor is required to control the movement of the carriage and the rotations of the conveyance rollers easily in synchronization with each other. Thus, the size and cost of a thermal printer can reliably be reduced.

According to another aspect of the present invention, the foregoing thermal printer is structured as claimed in claim 2 in such a manner that the drive-force transmission means has an output gear provided for an output shaft of the drive motor, a carriage drive gear provided for the carriage drive shaft, a rotative idle gear capable of always transmitting rotations of the output gear to the carriage drive gear, a roller drive gear provided for the roller drive shaft through a one-way clutch, and a rotative transmission gear capable of transmitting the drive force of the carriage drive gear to the roller drive gear.

As a result of the foregoing structure, the output gear is rotated by the rotational force of the drive motor so that the rotational force of the drive motor is always transmitted to the carriage drive gear through the idle gear. Moreover, the drive force transmitted to the carriage drive gear is transmitted to the roller drive shaft through the transmission gear, the roller drive gear and the one-way clutch only when the thermal head is moved into one direction at a position over the printable range.

According to another aspect of the present invention, the foregoing thermal printer is structured as claimed in claim 3 in such a manner that the roller drive gear has a tooth portion and a tooth-omitted portion structured in such a manner that the quantity of rotation of the roller drive gear is made to be different depending upon the position of the carriage for the purpose of making the quantity of rotation of the roller drive shaft to be the same regardless of the position of the carriage when the drive force of the roller drive gear is transmitted to the roller drive shaft through the one-way clutch.

As a result of the foregoing structure, when the drive force of the roller drive gear is transmitted to the roller drive shaft through the one-way clutch, the quantity of rotation of the roller drive shaft can reliably be made to be the same regardless of the position of the carriage.

According to another aspect of the present invention, the foregoing thermal printer is structured as claimed in claim 4 in such a manner that the roller drive gear has a guide tooth and a tooth to be guided is provided for the transmission gear, the tooth to be guided being capable of engaging to the guide tooth.

As a result of the foregoing structure, when the drive force of the transmission gear is transmitted to the roller drive gear, the guide tooth and the tooth to be guided are engaged to each other before the side surface of the tooth portion of the transmission gear comes in contact with the leading end of the tooth-omitted portion of the roller drive gear. As a result, generation of impact noise can be prevented which is generated when the side surface of the tooth portion of the transmission gear comes in contact with the leading end of the tooth-omitted portion of the roller drive gear. Moreover, transmission of the drive force of the transmission gear to the roller drive gear can smoothly be performed.

According to another aspect of the present invention, the foregoing thermal printer is structured as claimed in claim 5 in such a manner that transmission of the drive force of the drive motor to the conveyance rollers is performed after the thermal head has been separated from the platen by the cam portion.

As a result of the foregoing structure, one drive motor is able to easily control the movement of the carriage and rotations of the conveyance rollers in synchronization with each other. Moreover, the size and cost of a thermal printer can reliably be reduced.

Other objects, features and advantages of the invention will be evident from the following detailed description of the preferred embodiments described in conjunction with the attached drawings.

DESCRIPTION OF THE PREFERRED EMBODIMENT

An embodiment of the present invention will now be described with reference to the drawings.

Figure 1:
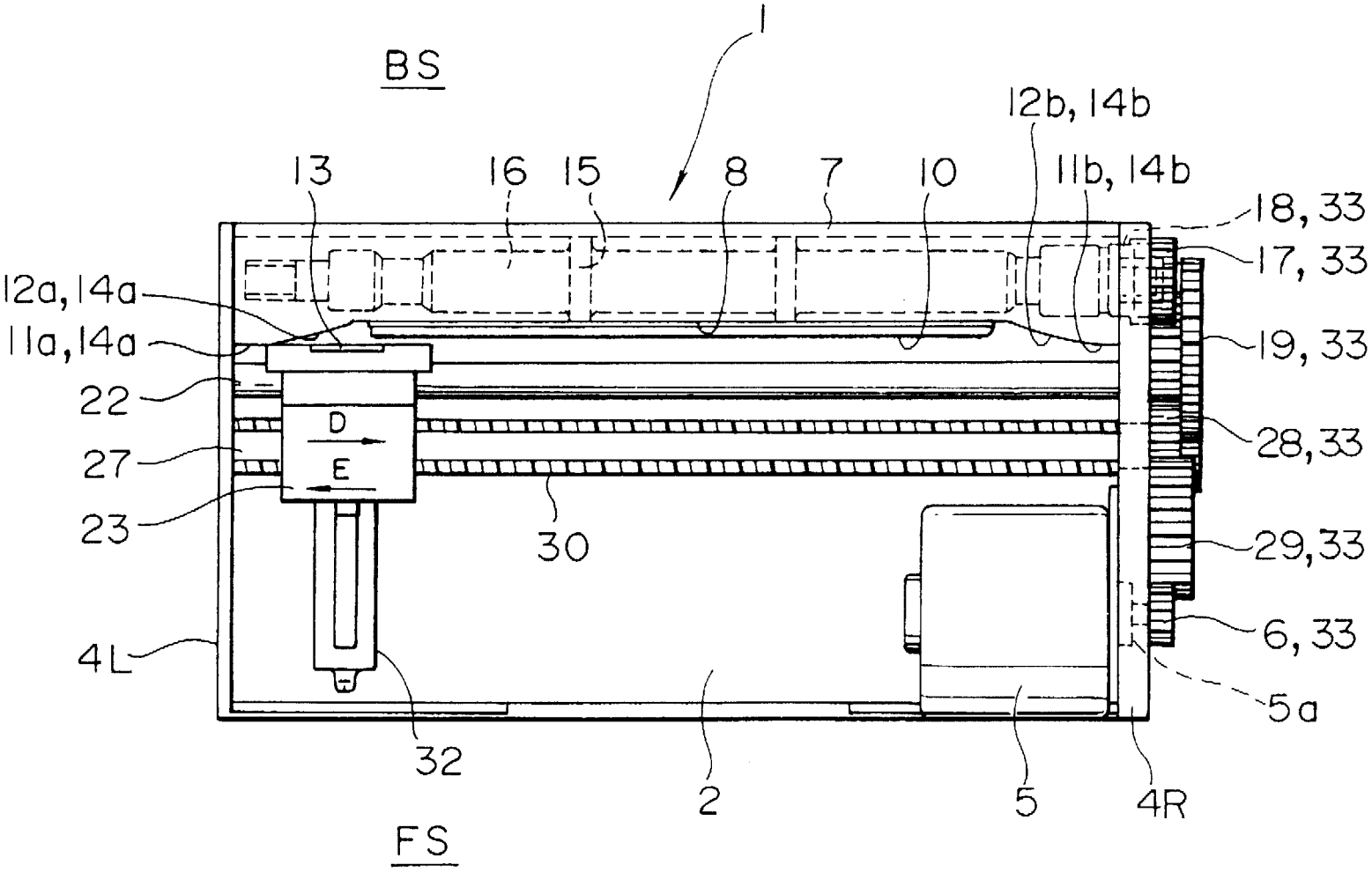
FIG. 1 is a plan view showing an essential portion of a thermal printer according to an embodiment of the present invention in a state where its carriage is located at a home position which is at the leftmost position in the movable range for the carriage.
Figure 2:
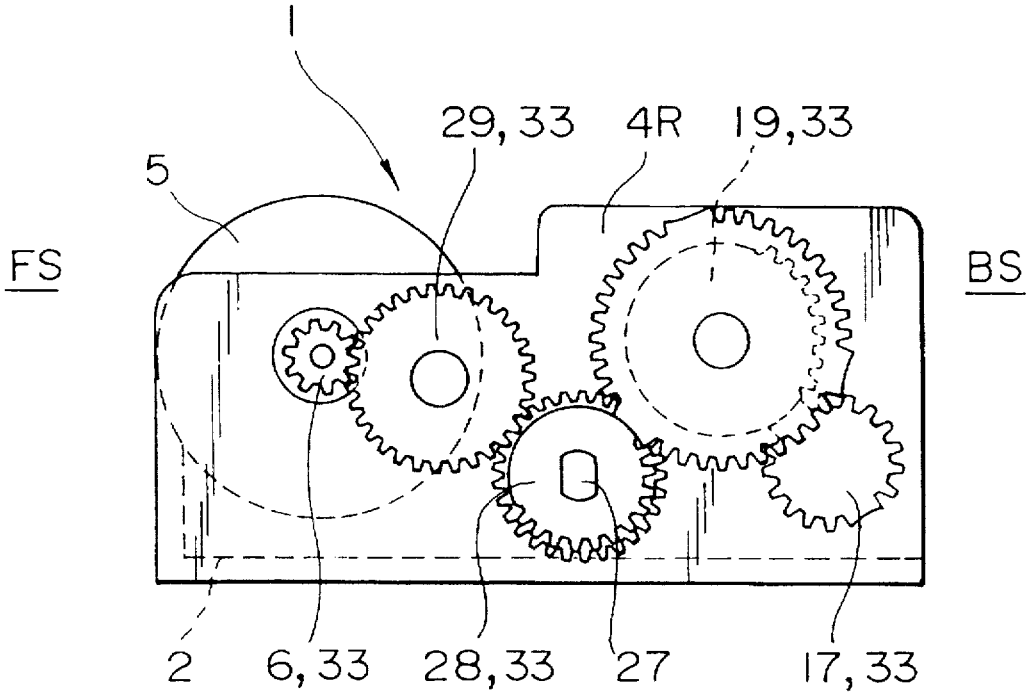
FIG. 2 is right side view of FIG. 1.
Figure 3:
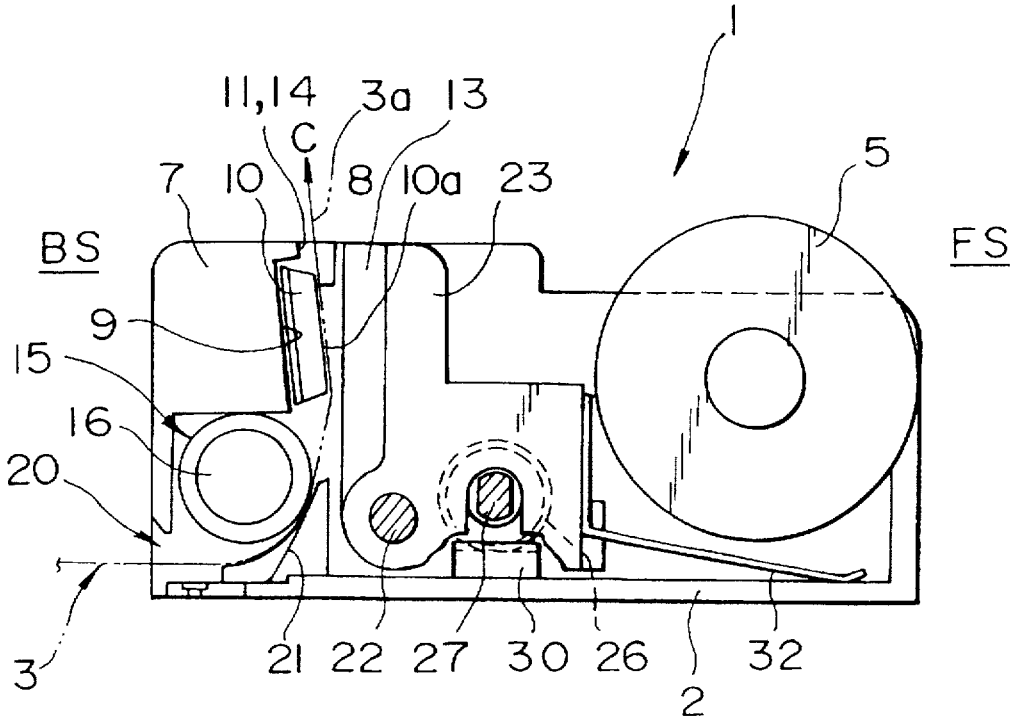
FIG. 3 is a partial left side view showing the internal structure the essential portion shown in FIG. 1.
Figure 4:
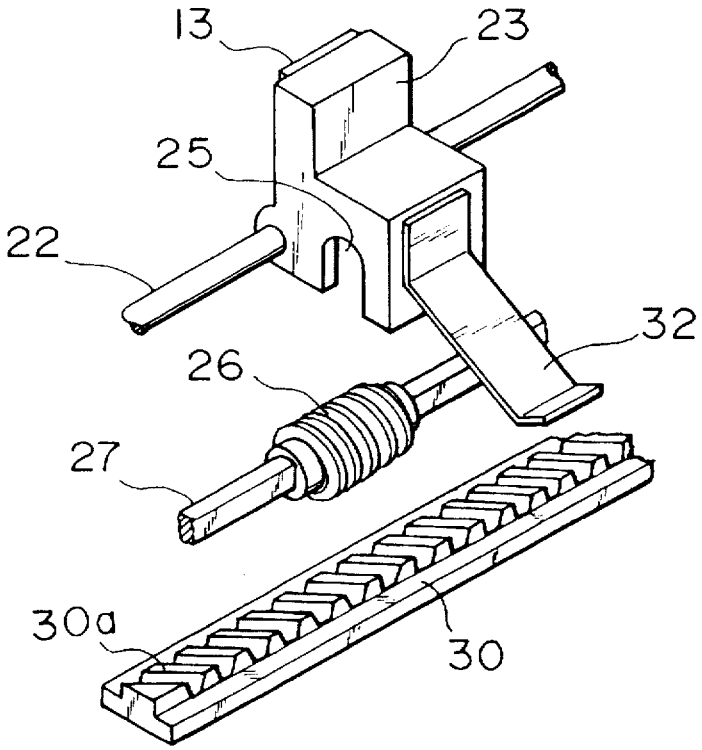
FIG. 4 is an exploded perspective view showing the structure of a portion including the carriage shown in FIG. 1.
Figure 5:
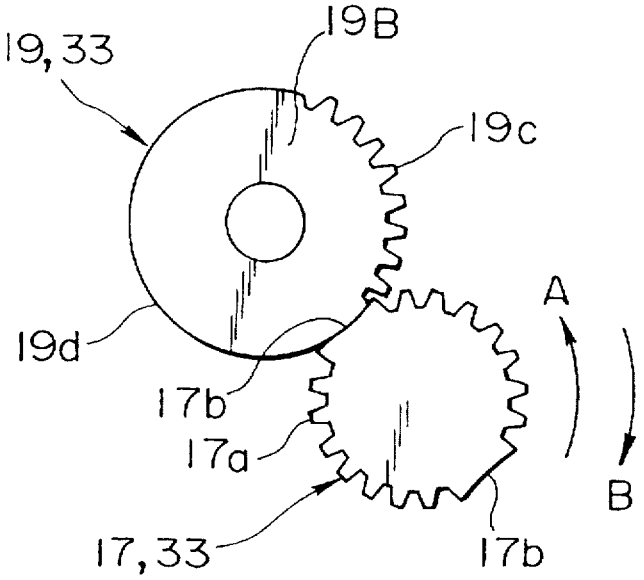
FIG. 5 is a partially enlarged view showing a portion including the roller drive gear shown in FIG. 1.
Figure 6:
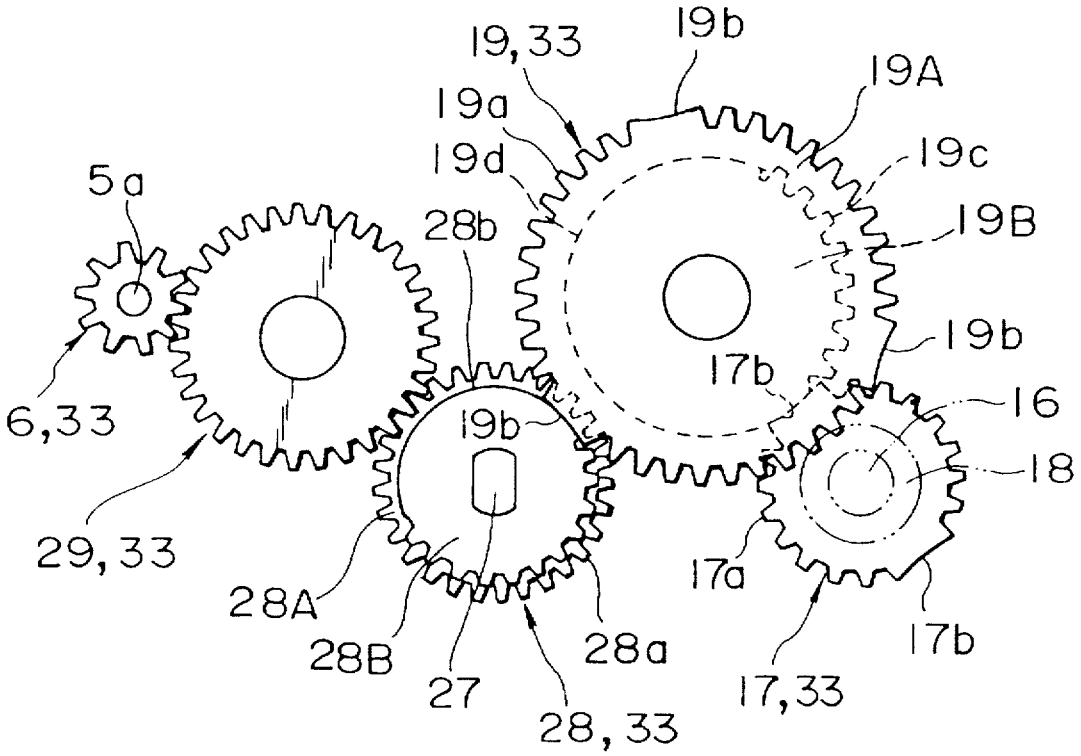
FIG. 6 is a view of explanatory showing the structure of the drive-force transmission means shown in FIG. 1.

FIGS. 1 to 6 illustrate the embodiment of the thermal printer according to the present invention. FIG. 1 is a plan view of an essential portion of the thermal printer. FIG. 2 is a right side view of the same. FIG. 3 is a left side view showing the internal structure of the thermal printer such that a portion is omitted from illustration. FIG. 4 is an exploded perspective view showing the structure of a portion in the vicinity of a carriage of the thermal printer. FIG. 5 is a partially enlarged view showing a portion in the vicinity of a roller drive gear. FIG. 6 is a view of explanatory showing the structure of a drive-force transmission means.

As shown in FIGS. 1 to 3, the thermal printer 1 according to this embodiment has a base frame 2 formed into a substantially rectangular shape. One of the side surfaces of the base frame 2, that is shown in the lower portion of FIG. 1, is formed into a front surface FS arranged to be capable of visually recognizing thermal printing paper 3 serving as a recording medium. Another side surface of the base frame 2, that is shown in the upper portion of FIG. 1, is formed into a back surface BS through which the thermal printing paper 3 can be supplied (fed). The base frame 2 has two ends in the lengthwise direction thereof as illustrated in the right and left directions in FIG. 1, the two ends being ends at which a pair of right and left side frames 4L and 4R is disposed, each of which is formed into a substantially rectangular shape, in such a manner that the side frames 4L and 4R face each other.

As shown in FIG. 1, a stepping motor 5 serving as a drive motor is disposed adjacent to the right end of the front surface FS of the base frame 2 in such a manner that its output shaft 5*a* faces the right. The output shaft 5*a* of the stepping motor 5 is disposed to penetrate the side frame 4R shown in the right portion in FIG. 4. Moreover, an output gear 6 is disposed at the leading end of the output shaft 5*a* in such a manner that the output gear 6 is disposed outside (to the right of) the side frame 4R.

As shown in FIGS. 1 and 3, a platen attaching member 7, having a substantially quadrilateral cross sectional shape, is disposed in the upper portion of the back surface BS of the base frame 2. The platen attaching member 7 is disposed in such a manner that its two ends in the lengthwise direction shown as the right and left directions in FIG. 1 are supported by the opposing surfaces of the side frames 4R and 4L. The lengthwise central portion in the upper portion the platen attaching member 7 facing the front surface FS is formed into a recess 8, that faces the back surface BS for a distance longer than the width of the thermal printing paper 3. A platen attaching portion 9, having a recess shape, is formed below the recess 8. The platen attaching portion 9 is attached in such a manner that a printing surface 10*a* of a plate-like platen 10 is disposed substantially vertically and the printing surface 10*a* of the platen 10 projects toward the front surface FS through the recess 8. The two lengthwise ends in the upper portion of the platen attaching member 7 located to face the front surface FS are formed into projections 11*a* and 11*b* located nearer the front surface FS than the recess 8. The projections 11*a* and 11*b* and the recess 8 are connected to one another through the corresponding inclined surfaces 12*a* and 12*b*. A pair consisting of the projection 11*a* and the inclined surface 12*a*, which are disposed in the left portion of FIG. 1, and a pair consisting of the projection 11*b* and the inclined surface 12*b*, which are disposed in the right portion of FIG. 1, form a pair of lateral cam portions 14*a* and 14*b* for bringing a thermal head 13, to be described later, into contact with the platen 10 and for separating the two elements from each other.

At a position of the back surface BS of the base frame 2 below the platen attaching member 7, there are disposed conveyance rollers 15 disposed to run parallel to the platen 10 and made to be rotative. At a right end of a roller drive shaft 16 of the conveyance rollers 15 when viewed in FIG. 1, there is, through a one-way clutch 18, attached a roller drive gear 17 for rotating the roller drive shaft 16, the roller drive gear 17 being disposed on the outside of the side frame 4R shown in the right portion in FIG. 1. That is, the roller drive gear 17 is made to be a clutch gear by the one-way clutch 18 so as to transmit the rotational force (the drive force) to the roller drive shaft 16 only when the roller drive gear 17 is rotated in a predetermined direction.

That is, the roller drive gear 17 according to this embodiment is structured such that counterclockwise rotation of the roller drive gear 17 is inhibited by the one-way clutch 18 when the roller drive gear 17 is, as shown in FIG. 5, rotated counterclockwise as indicated by an arrow A when viewed from a front position. Thus, the rotational force (the drive force) of the roller drive gear 17 is not transmitted to the roller drive shaft 16 but the roller drive gear 17 rotates idly so that the thermal printing paper 3 is not conveyed (idle directional operation). When the roller drive gear 17 is rotated clockwise as indicated by an arrow B when viewed from the front position, the clockwise rotation (the drive force) of the roller drive gear 17 is transmitted to the roller drive shaft 16 through the one-way clutch 18 so that the thermal printing paper 3 is conveyed (transmission directional operation).

As shown in FIG. 5, the roller drive gear 17 is provided with tooth portions 17*a* formed on the outer surface thereof to substantially oppose each other except portions. Portions of the roller drive gear 17, on which the tooth portions 17*a* are not formed, are formed into tooth-omitted portions 17*b* in a concave shape. Thus, interference between the tooth-omitted portions 17*b* and tooth-omitted portions 19*b* of a second gear 19B of a transmission gear 19, to be described later, can be prevented.

In the back surface BS of the base frame 2 below the platen attaching member 7, there is formed a paper-supply port 20 through which the thermal printing paper 3 is supplied. Moreover, a pressing spring 21 for pressing the thermal printing paper 3 against the conveyance rollers 15 with appropriate pressure is formed adjacent to the end of the back surface BS of the base frame 2. That is, when the conveyance rollers 15 are rotated, the thermal printing paper 3 is conveyed (fed) in a conveyance direction (in a paper feeding direction) as indicated by an arrow C shown in FIG. 3.

As shown in FIGS. 1 and 3, a support shaft 22 substantially running parallel to the platen 10 is disposed in front of the platen 10 and below the same. The support shaft 22 has two ends respectively attached to the side frames 4R and 4L. To the support shaft 22, there is attached a carriage 23 which is allowed to reciprocate to the right and left when viewed in FIG. 1 by the support shaft 22 and to rotate around the support shaft 22.

The carriage 23 has, in an upper portion thereof when viewed in FIG. 1 and facing the back surface BS, the thermal head 13 disposed to oppose the platen 10. The thermal head 13 has a plurality of heating devices (not shown) aligned to selectively generate heat in accordance with information about printing. In a head down state where the thermal head 13 is pressed against the platen 10, characters and/or images can be printed onto the thermal printing paper 3 supported by the platen 10.

As shown in FIG. 4, the carriage 23 has a recess 25 in the lower portion thereof, the recess 25 including a worm 26. The worm 26 is spline-connected to a carriage drive shaft 27 which runs parallel to the support shaft 22 and has a substantially quadrilateral cross sectional shape. The carriage drive shaft 27 is rotatively supported by the side frames 4R and 4L. A carriage drive gear 28 for rotating the carriage drive shaft 27 is attached to the right end of the carriage drive shaft 27 shown in the right portion of FIG. 1 in such a manner that the carriage drive gear 28 is located on the outside (to the right) of the side frame 4R shown in the right portion of FIG. 1. The carriage drive gear 28 is a two-stepped gear consisting of a full-face gear 28A having a spur-gear-like shape and arranged to always engage to an idle gear 29, to be described later; and a tooth-decreased gear 28B formed on the upper surface of the full-face gear 28A shown in the right portion of FIG. 1 and allowed to engage to a transmission gear 19, to be described later. The tooth-decreased gear 28B has the outer surface on which a tooth portion 28*a* is formed for only a half circumference of the tooth-decreased gear 28B. Moreover, a tooth-omitted portion 28*b* is formed for a residual half circumference of the same. The tooth-decreased gear 28B has a diameter smaller than that of the full-face gear 28A. Moreover, the outer surface of the tooth-omitted portion 28*b* of the tooth-decreased gear 28B is located more adjacent to the axial center than the diameter of the bottom of the full-face gear 28A.

As shown in FIGS. 1, 3 and 4, the base frame 2 below the carriage drive shaft 27 has a rack plate 30 running parallel to the carriage drive shaft 27. A rack tooth 30*a* to be engaged to a worm 26, is formed in the upper portion of the rack plate 30.

That is, when the carriage drive shaft 27 is rotated, the worm 26 spline-connected to the carriage drive shaft 27 is rotated. The worm 26 is able to move on the carriage drive shaft 27 in the right and left directions as indicated by arrows D and E shown in FIG. 1 by the rack tooth 30*a* formed on the rack plate 30 engaged to the worm 26. When the worm 26 is moved, the carriage 23 and the thermal head 13 provided for the carriage 23 are, within a predetermined movable range MA and along the platen 10, moved in the right and left directions as indicated by arrows D and E shown in FIG. 1. The range, in which the thermal head 13 is moved in a head down state in which the thermal head 13 is pressed against the platen 10, is a printable range PA.

The carriage 23 has a leaf spring 32 adjacent to the front surface FS, the leaf spring 32 serving as an urging member for always urging the carriage 23 toward the platen attaching member 7 and the platen 10. An end of the leaf spring 32 is secured to the carriage 23 at a position adjacent to the front surface FS. Another end (the free end) of the leaf spring 32 is in contact with the upper surface of the base frame 2 and arranged to slide on the base frame 2 when the carriage 23 is moved.

That is, the leaf spring 32 urges the carriage 23 in such a manner that the thermal head 13 is pressed against the platen 10.

As shown in FIGS. 1 and 2, the side frame 4R shown in the right portion of FIG. 1 has an outer (right) side surface on which are rotatively disposed the idle gear 29 made to be rotative for transmitting the rotation of the output gear 6 to the carriage drive gear 28 and formed into a substantially spur gear shape; and the transmission gear 19 made to be rotative to transmit the rotation of the carriage drive gear 28 to the roller drive gear 17.

The transmission gear 19 is formed into a two-stepped gear, as shown in FIG. 6, consisting of a first gear 19A capable of engaging to the tooth-decreased gear 28B of the carriage drive gear 28 and formed into a substantially spur gear shape; and the second gear 19B formed on the lower surface of the first gear 19A shown in the left portion of FIG. 1, capable of engaging to the roller drive gear 17 and formed into a substantially spur gear shape. The transmission gear 19 according to this embodiment is rotated once when the carriage drive gear 28 rotates three times. A tooth portion 19*a* formed on the outer surface of the first gear 19A of the transmission gear 19 has tooth-omitted portions 19*b* at each ⅓ circle of the first gear 19A. The tooth-omitted portion 19*b* is formed into a concave shape to prevent interference with the tooth-omitted portion 28*b* of the tooth-decreased gear 28B of the carriage drive gear 28. Moreover, the second gear 19B has a diameter smaller than that of the first gear 19A. The second gear 19B has the outer surface, on which tooth portions 19*c* are formed for only ⅓ circle of the second gear 19B and tooth-omitted portions 19*d* are formed for the residual ⅔ circle of the same. The outer surface of the second gear 19B is located more adjacent to the axis center than the diameter of the bottom of the first gear 19A.

The output gear 6, the idle gear 29, the carriage drive gear 28, the transmission gear 19, the roller drive gear 17 and the one-way clutch 18 form a drive-force transmitting means 33 according to this embodiment.

The operation of this embodiment having the foregoing structure will now be described with reference to FIGS. 1 to 9.

Figure 7:
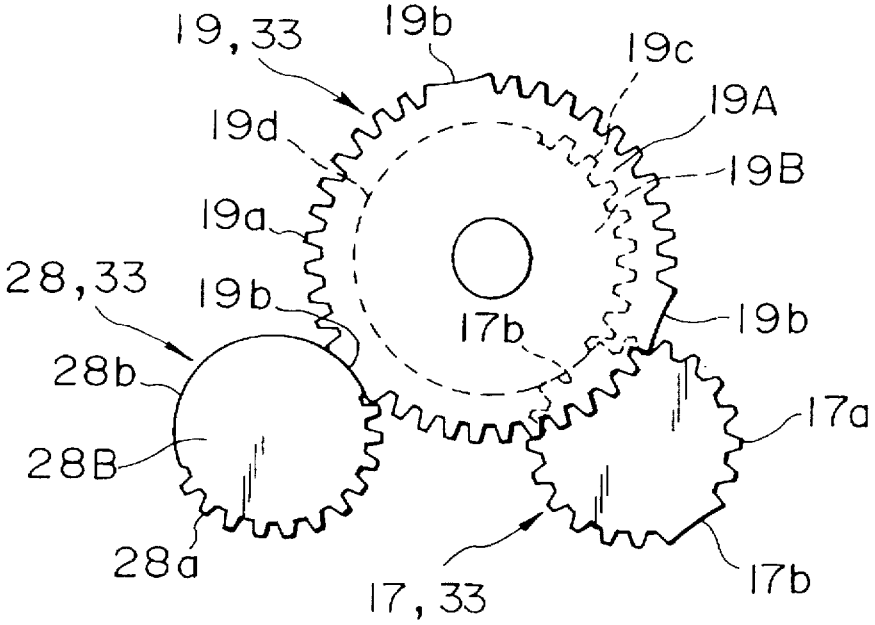
FIG. 7 is a partially enlarged view showing a portion including the transmission gear shown in FIG. 1.
Figure 8:
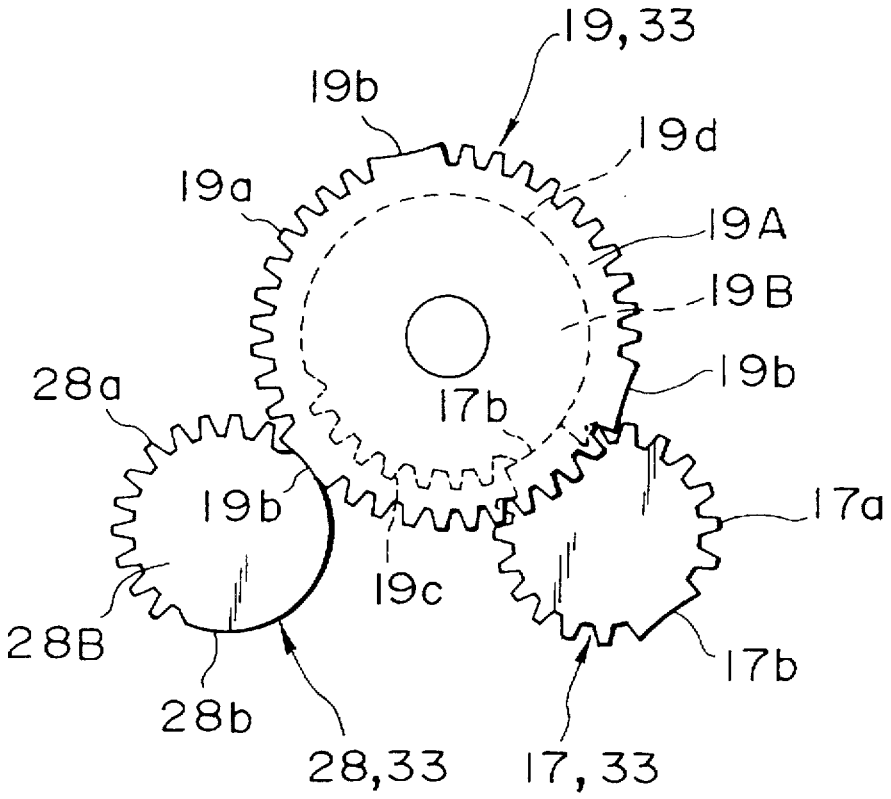
FIG. 8 is a partially enlarged view showing a portion including the transmission gear in a state where the carriage of the thermal printer according to the embodiment of the present invention is located at the rightmost position in the movable range opposing the home position.
Figure 9:
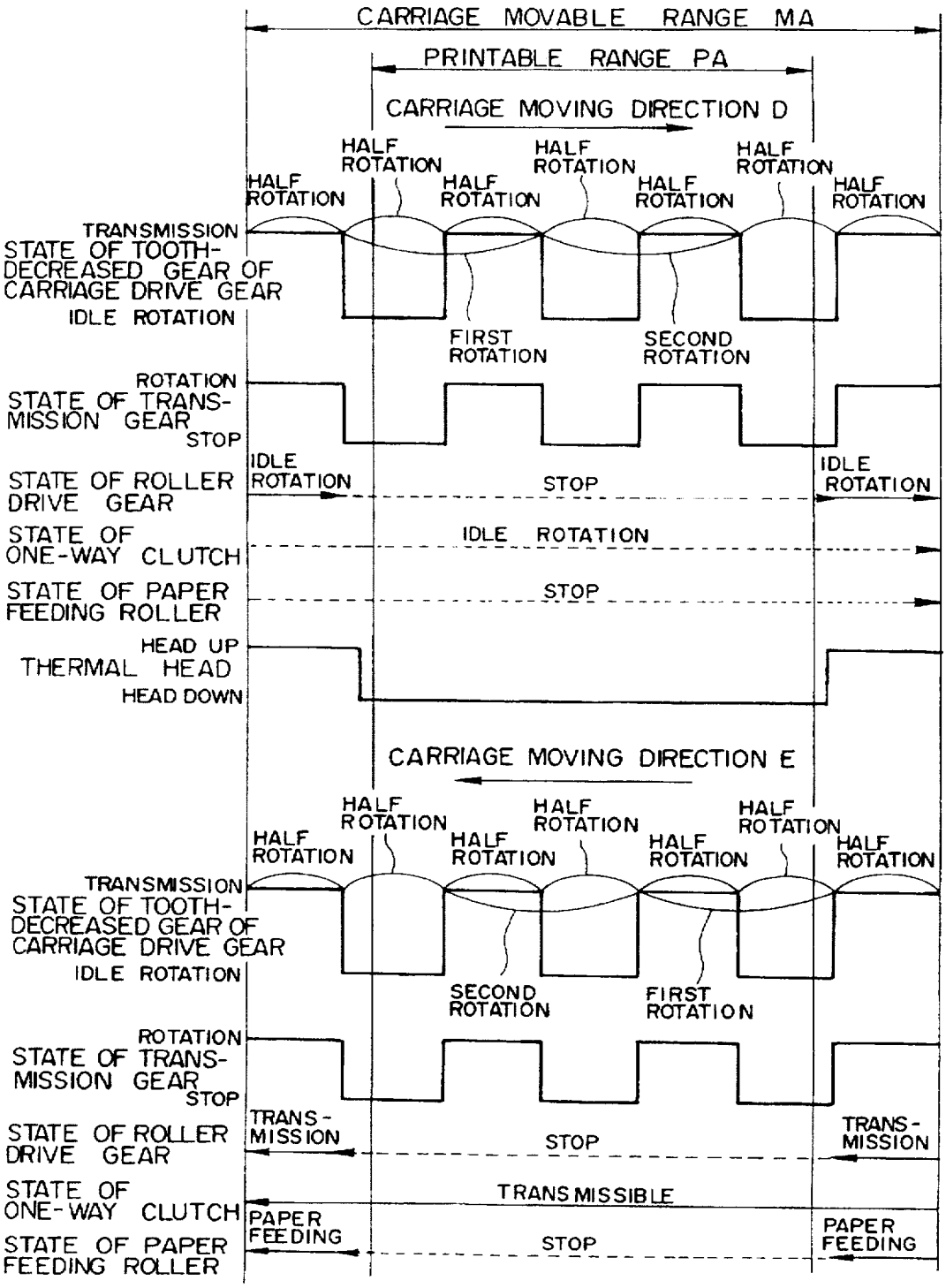
FIG. 9 is a view of explanatory showing the operation of an essential portion of the thermal printer according to the embodiment of the present invention.

FIGS. 1 to 6 show an initial state in which the carriage is positioned at the leftmost position in the movable range. FIG. 7 shows a partially-enlarged view showing a portion including the transmission gear in the initial state. FIG. 8 is a partially-enlarged view showing a portion including the transmission gear in a state where the carriage is positioned at the rightmost position in the movable range, the rightmost position being opposing the home position. FIG. 9 shows a view of explanatory showing the operation of the essential portion of the thermal printer according to this embodiment.

As shown in FIGS. 1 to 6, in the initial state where the carriage 23 of the thermal printer 1 according to this embodiment is located at the home position which is the leftmost position in the movable range MA, the left end of the carriage 23 shown in the left portion of FIG. 1 and facing the back surface BS is, by the urging force of the leaf spring 32, brought into contact with the projection 11*a* forming the cam portion 14*a* provided to the left end of the platen attaching member 7 shown in the left portion of FIG. 1. The thermal head 13 is therefore in the head up state, in which the thermal head 13 is separated from the platen 10, and is located to oppose the inclined surface 12*a* forming the cam portion 14*a* provided for the left end of the platen attaching member 7 shown in the left portion of FIG. 1.

The drive-force transmission means 33 is, in the initial state, brought into an engaged state where the output gear 6 and the idle gear 29 are engaged to each other as shown in FIG. 6. Moreover, the idle gear 29 is engaged to the full-face gear 28A of the carriage drive gear 28. The tooth portion 28*a* of the tooth-decreased gear 28B of the carriage drive gear 28 is, as shown in FIG. 7, located to face diagonally downwards in the right direction. Moreover, the tooth-omitted portion 19*b* of the first gear 19A of the transmission gear 19 is located to oppose the tooth-omitted portion 28*b* of the tooth-decreased gear 28B in such a manner that the tooth-omitted portion 19*b* is located adjacent to the tooth portion 28*a* of the tooth-decreased gear 28B. Thus, the carriage drive gear 28 and the transmission gear 19 are not engaged to each other. Moreover, the tooth portion 19*c* of the second gear 19B of the transmission gear 19 is, as shown in FIG. 5, located to face diagonally downwards in the right direction. The tooth-omitted portion 17*b* of the roller drive gear 17 opposes the tooth-omitted portion 19*d* of the second gear 19B in such a manner that the tooth-omitted portion 17*b* of the roller drive gear 17 is located adjacent to the tooth portion 19*c* of the second gear 19B. Thus, the transmission gear 19 and the roller drive gear 17 are not engaged to each other.

The thermal printing paper 3 is inserted by the hand of the user or the like through the paper-supply port 20 and pressed against the conveyance rollers 15 with the urging force of the pressing spring 21.

When the stepping motor 5 is, in the initial state, rotated in accordance with a control command (not shown) and the output shaft 5*a* of the stepping motor 5 is therefore rotated counterclockwise when viewed in FIG. 6, the output gear 6 attached to the leading end of the output shaft 5*a* starts rotating counterclockwise. Thus, the rotational force (drive force) of the stepping motor 5 is, through the idle gear 29, transmitted to the carriage drive gear 28. As a result, the carriage drive gear 28 starts rotating counterclockwise when viewed in FIG. 6. When the carriage drive gear 28 is rotated counterclockwise, the carriage drive shaft 27 starts rotating counterclockwise and, therefore, the worm 26 spline-connected to the carriage drive shaft 27 starts rotating counterclockwise. Therefore, the worm 26 starts moving on the rack plate 30 to the right as indicated by an arrow D of FIG. 1. When the worm 26 has been moved to the right, the carriage 23 starts moving to the right as indicated by an arrow D shown in FIG. 1.

First half counterclockwise rotation of the carriage drive gear 28 caused from the counterclockwise rotation of the stepping motor 5 causes the tooth portion 28*a* of the tooth-decreased gear 28B of the carriage drive gear 28 to be engaged to the tooth portion 19*a* of the first gear 19A of the transmission gear 19 as shown in FIG. 8. Thus, the transmission gear 19 is rotated clockwise by ⅓ rotation when viewed in FIG. 6. At this time, the tooth portion 19*c* of the second gear 19B of the transmission gear 19 is engaged to the tooth portion 17*a* of the roller drive gear 17 so that the roller drive gear 17 is counterclockwise rotated by half rotation when viewed in FIG. 6. Since the roller drive gear 17 is connected to the roller drive shaft 16 through the one-way clutch 18 as described above, the counterclockwise rotation of the roller drive gear 17 as indicated by the arrow A of FIG. 5 is not transmitted to the roller drive shaft 16. Thus, the roller drive gear 17 idly rotates.

The thermal head 13, moved together with the carriage 23 due to the first half counterclockwise rotation of the carriage drive gear 28 caused from the counterclockwise rotation of the stepping motor 5, is pressed against the platen 10 due to the urging force of the leaf spring 32 during the movement of the left end of the carriage 23 adjacent to the back surface BS toward the recess 8 along the inclined surface 12*a* for forming the cam portion 14*a* disposed at the left end of the platen attaching member 7 shown in the left portion of FIG. 1 in front of the printable range PA. Thus, the thermal head 13 is brought to the head down state.

Next two and half counterclockwise rotations of the carriage drive gear 28 caused from the counterclockwise rotation of the stepping motor 5 cause the carriage 23 to further move to the right while the head down state being maintained in which the thermal head 13 is pressed against the platen 10. During the foregoing movement, the plurality of the heating devices (not shown) aligned on the thermal head 13 selectively generate heat in accordance with information about printing when the thermal head 13 is located in the printable range PA so that characters are printed onto the thermal printing paper 3.

Leading two rotations of the two and half counterclockwise rotations of the carriage drive gear 28 caused from the counterclockwise rotation of the stepping motor 5 cause the transmission gear 19 to be rotated to the initial position. During the final half rotation of the two and half rotations of the carriage drive gear 28, the tooth-omitted portion **19*b* of the first gear 19A of the transmission gear 19 opposes the tooth-omitted portion 28*b* of the tooth-decreased gear 28B of the carriage drive gear 28. Therefore, the transmission gear 19** is not rotated but the same is stopped.

That is, the first half rotation of the carriage drive gear 28 causes the transmission gear 19 to be rotated by ⅓ rotation to a position at which the tooth-omitted portion **19*b* of the first gear 19A of the transmission gear 19 opposes the tooth-omitted portion 28*b* of the tooth-decreased gear 28B of the carriage drive gear 28. During the next half rotation of the carriage drive gear 28, the transmission gear 19 is not rotated but the same is stopped. During the leading two rotations of the two and half counterclockwise rotations of the carriage drive gear 28 caused from the counterclockwise rotation of the stepping motor 5, the transmission gear 19 is not rotated during the first half rotation of the carriage drive gear 28 but the same is stopped. The next half rotation of the carriage drive gear 28 causes the transmission gear 19 to be rotated by ⅓ rotation. During the next half rotation of the carriage drive gear 28, the transmission gear 19 is not rotated but the same is stopped. The next half rotation of the carriage drive gear 28 causes the transmission gear 19** to be rotated by ⅓ rotation.

During the two and half counterclockwise rotations of the carriage drive gear 28, the tooth-omitted portion **19*d* of the second gear 19B of the transmission gear 19 opposes the tooth-omitted portion 17*b* of the roller drive gear 17. Therefore, the roller drive gear 17** is not rotated but the same is stopped.

The final counterclockwise half rotation of the carriage drive gear 28 caused from the counterclockwise rotation of the stepping motor 5 causes the tooth portion **28*b* of the tooth-decreased gear 28B of the carriage drive gear 28 to be engaged to the tooth portion 19*a* of the first gear 19A of the transmission gear 19 similarly to the first counterclockwise half rotation of the carriage drive gear 28. Thus, the transmission gear 19 is rotated by ⅓ rotation when viewed in FIG. 6. At this time, the tooth portion 19*c* of the second gear 19B of the transmission gear 19 is engaged to the tooth portion 17*a* of the roller drive gear 17 so that the roller drive gear 17 is rotated counterclockwise by half rotation when viewed in FIG. 6. Since the roller drive gear 17 is, as described above, connected to the roller drive shaft 16 through the one-way clutch 18, the counterclockwise rotation of the roller drive gear 17 as indicated by the arrow A shown in FIG. 5 is not transmitted to the roller drive shaft 16. As a result, the roller drive gear 17** rotates idly.

The thermal head 13, which is moved together with the carriage 23 during the final half counterclockwise rotation of the carriage drive gear 28 caused from the counterclockwise rotation of the stepping motor 5, is separated from the platen 10 and brought to the head up state at the position over the printable range PA during the movement of the right end of the carriage 23 facing the back surface BS toward the projection **11*b* on the inclined surface 12*b* forming the cam portion 14*b* disposed at the right end of the platen attaching member 7 shown in the right portion of FIG. 1. Thus, the movement of the carriage 23 to the right as indicated by the arrow D shown in FIG. 1** is completed.

In the state where the carriage 23 is located at the rightmost position in the movable range MA opposing the home position, the tooth-decreased gear 28B of the carriage drive gear 28 is, as shown in FIG. 8, in a state where its tooth portion **28*a* faces substantially upwards in the diagonally right direction. The tooth-omitted portion 19*d* of the second gear 19B of the transmission gear 19 is located to oppose the tooth-omitted portion 28*b* of the tooth-decreased gear 28B in such a manner that the tooth-omitted portion 19*d* is located adjacent to the tooth portion 28*a* of the tooth-decreased gear 28B. Thus, the carriage drive gear 28 and the transmission gear 19** are not engaged to each other.

Moreover, the second gear 19B of the transmission gear 19 is, as shown in FIG. 8, located in such a manner that the tooth portion **19*c* is located to substantially face diagonally downwards to the left. The tooth-omitted portion 17*b* of the roller drive gear 17 is located to oppose the tooth-omitted portion 19*d* of the second gear 19B in such a manner that the tooth-omitting portion 17*b* is located adjacent to the tooth portion 19*c* of the second gear 19B. Thus, the transmission gear 19 and the roller drive gear 17** are not engaged to each other.

Thus, the movement of the carriage 23 to the right as indicated by the arrow D shown in FIG. 1 and printing of one line by the thermal head 13 onto the thermal printing paper 3 are completed.

When the stepping motor 5 is rotated in accordance with a control command (not shown) in a state where the carriage 23 is located at the rightmost position in the movable range MA opposing the home position and, therefore, the output shaft **5*a* of the stepping motor 5 starts rotating clockwise when viewed in FIG. 6, the output gear 6 attached to the leading end of the output shaft 5*a* starts rotating clockwise. As a result, the rotational force (the drive force) of the stepping motor 5 is transmitted to the carriage drive gear 28 through the idle gear 29. As a result, the carriage drive gear 28 starts rotating clockwise when viewed in FIG. 6. The clockwise rotation of the carriage drive gear 28 causes the carriage drive shaft 27 to start rotating clockwise. Thus, the worm 26 spline-connected to the carriage drive shaft 27 starts rotating clockwise. As a result, the worm 26 starts moving to the left on the rack plate 30 as indicated by an arrow E shown in FIG. 1. The leftward movement of the worm 26 causes the carriage 23 to be moved to the left as indicated by the arrow E shown in FIG. 1**.

The first clockwise half rotation of the carriage drive gear 28 caused from the clockwise rotation of the stepping motor 5 causes the tooth portion **28*a* of the tooth-decreased gear 28B of the carriage drive gear 28 to be engaged to the tooth portion 19*a* of the first gear 19A. Thus, the transmission gear 19 is rotated counterclockwise by ⅓ rotation when viewed in FIG. 6. At this time, the tooth portion 19*c* of the second gear 19B of the transmission gear 19 is engaged to the tooth portion 17*a* of the roller drive gear 17 so that the roller drive gear 17 is rotated clockwise by a predetermined angular degree (to the position of the tooth-omitted portion 17*b*** opposing the roller drive gear 17) when viewed in FIG. 6. The clockwise rotation of the roller drive gear 17 as indicated by the arrow A shown in FIG. 5 is transmitted to the roller drive shaft 16 connected through the one-way clutch 18. Thus, the roller drive shaft 16 is rotated clockwise by half rotation. The rotation of the roller drive shaft 16 causes the conveyance rollers 15 to be rotated clockwise. The clockwise rotations of the conveyance rollers 15 cause the thermal printing paper 3 to be moved (conveyed) in the conveyance direction as indicated by the arrow C shown in FIG. 3. Thus, the line feeding operation for a predetermined distance is performed for the purpose of printing the next line.

The next two and half clockwise rotations of the carriage drive gear 28 caused from the clockwise rotation of the stepping motor 5 causes the carriage 23 to be further moved to the left in such a manner that its head down state where the thermal head 13 is pressed against the platen 10, is maintained. When the thermal head 13 is located in the printable range PA during the foregoing movement, the plurality of heating devices (not shown) aligned on the thermal head 13 selectively generate heat in accordance with information about printing so that characters for the next line are printed on the thermal printing paper 3.

The operation of the transmission gear 19 during the two and half clockwise rotations of the carriage drive gear 28 caused from the clockwise rotation of the stepping motor 5 is performed such that stop, ⅓ rotation, stop, ⅓ rotation and stop are performed whenever the carriage drive gear 28 rotates half. Then, the carriage drive gear 28 is restored to the state shown in FIG. 8.

During the two and half clockwise rotations of the carriage drive gear 28, the tooth-omitted portion 19*d* of the second gear 19B of the transmission gear 19 is located to oppose the tooth-omitted portion 17*b* of the roller drive gear 17. Therefore, the roller drive gear 17 is not rotated but the same is stopped.

The final half clockwise rotation of the carriage drive gear 28 caused from the clockwise rotation of the stepping motor 5 causes the roller drive gear 17 and the roller drive shaft to be rotated clockwise through the transmission gear 19 similarly to the first half clockwise rotation of the carriage drive gear 28. Thus, the thermal printing paper 3 is conveyed (moved) so that the line feeding operation for a predetermined distance is performed to print the next line.

As described above, the leftward movement of the carriage 23 in a direction as indicated by the arrow E shown in FIG. 1, the operation of the thermal head 13 to print characters for one line on the thermal printing paper 3 and the movement of the thermal printing paper 3 for feeding the line are completed.

The operation of an essential portion of the thermal printer according to this embodiment will now be described with reference to FIG. 9.

As a result, the thermal printer 1 according to this embodiment enables the carriage 23 and the conveyance rollers 15 to be operated by only one stepping motor 5. Moreover, the drive-force transmission means 33 is able to easily control the operation for moving the carriage 23 and that for rotating the conveyance rollers 15 in synchronization with each other. Thus, the size and cost of the thermal printer 1 can reliably be reduced.

This embodiment has the foregoing structure such that the transmission of the rotational force of the stepping motor 5 to the conveyance rollers 15 is performed in the head up state after the thermal head 13 has been separated from the platen 10 by the cam portions 14*a* and 14*b*. Therefore, interference (the thermal printing paper 3 is undesirably conveyed during the movement of the thermal head 13) between the movement of the thermal head 13 caused from the movement of the carriage 23 and the conveyance of the thermal printing paper 3 by the conveyance rollers 15 can reliably be prevented.

In this embodiment, the carriage drive gear 28 is rotated by three and half rotations to move the carriage 23 from one end to the other end such that the intermediate two and half rotations of the three and half rotations of the carriage drive gear 28 are assigned to the movement of the carriage 23 and each half clockwise rotation of the carriage 23 at the two ends of the movable range MA is used to move (convey) the thermal printing paper 3. However, change of the shape and the like of each of the gears 17, 19 and 28 forming the drive-force transmission means 33 enables the speed of rotations of the carriage drive gear 28 to be determined arbitrarily. In the foregoing case, it is preferable that the number of rotations of the carriage drive gear 28 required to move the carriage 23 from one end to the other end is N/M and each m/M rotation is used for the conveyance rollers 15 to convey the paper (where each of M and N is an integer, $N=M\times n+m$, $m<m$, and n is an integer).

The thermal head 13 may movably be provided for the carriage 23 to enable the thermal head 13 to approach and move away from the platen 10.

A modification of the drive-force transmission means adaptable to the thermal printer according to this embodiment will now be described with reference to FIGS. 10 to 16. The same elements as those of the drive-force transmission means according to the foregoing embodiment are given the same reference numerals and the same elements are omitted from description.

Figure 10:
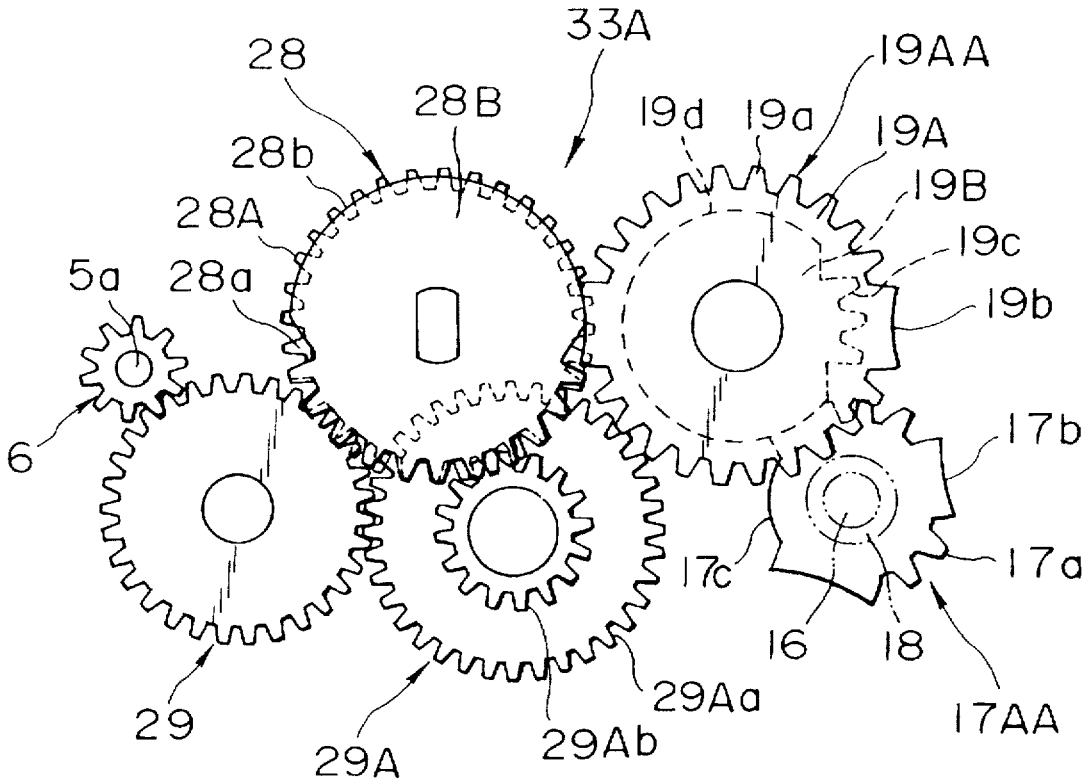
FIG. 10 is a view similar to FIG. 6 and showing the structure of a modification of the drive-force transmission means of the thermal printer according to the present invention.
Figure 11:
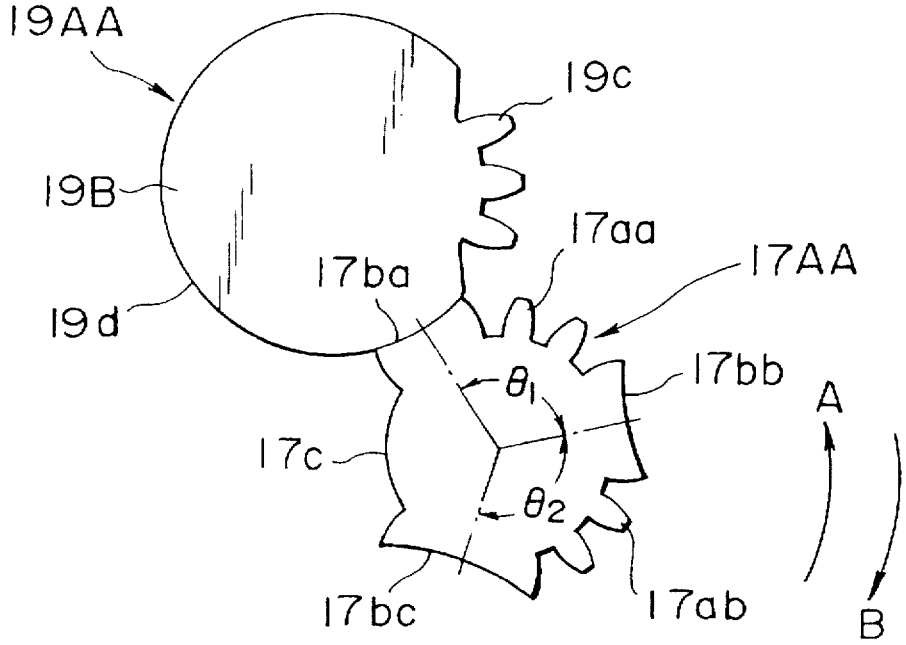
FIG. 11 is a view similar to FIG. 5 and showing a portion including the roller drive gear shown in FIG. 10.
Figure 12:
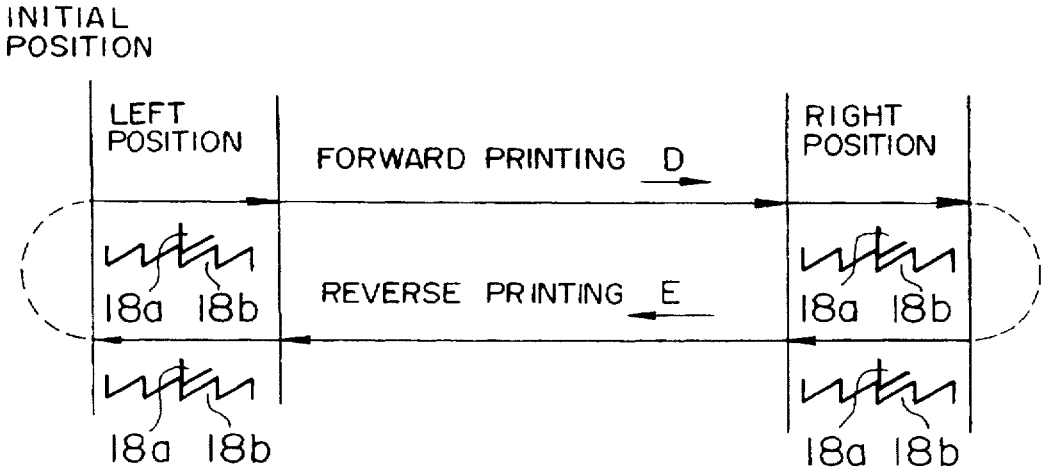
FIG. 12 is a view of explanatory showing the operation of a one-way clutch.
Figure 13A:
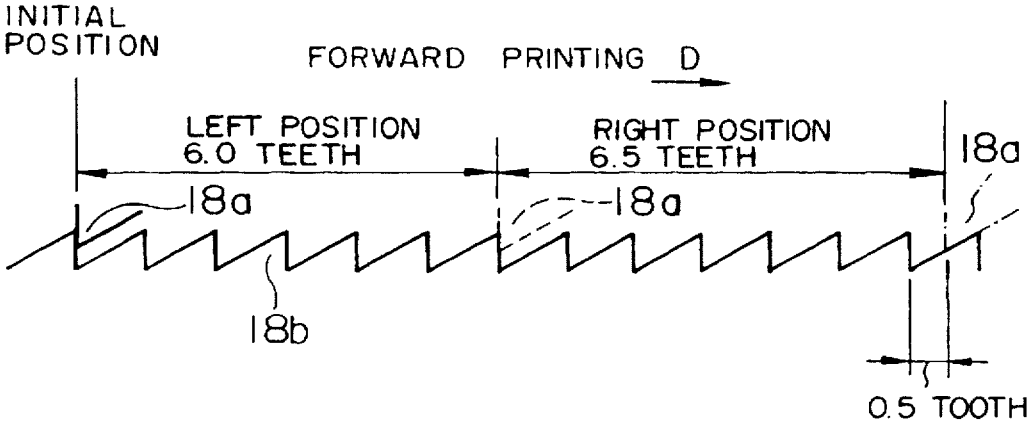
FIGS. 13A and 13B are explanatory views showing the operation of a roller drive gear of the drive-force transmission means shown in FIG. 10.
Figure 13B:
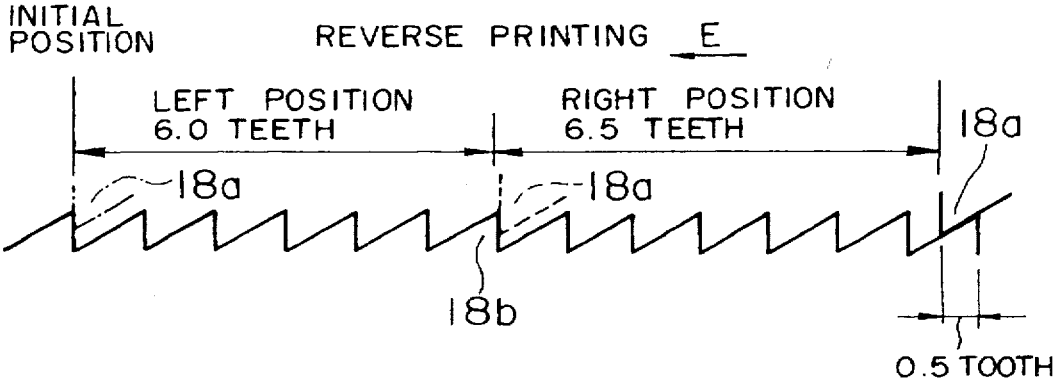
Figure 14:
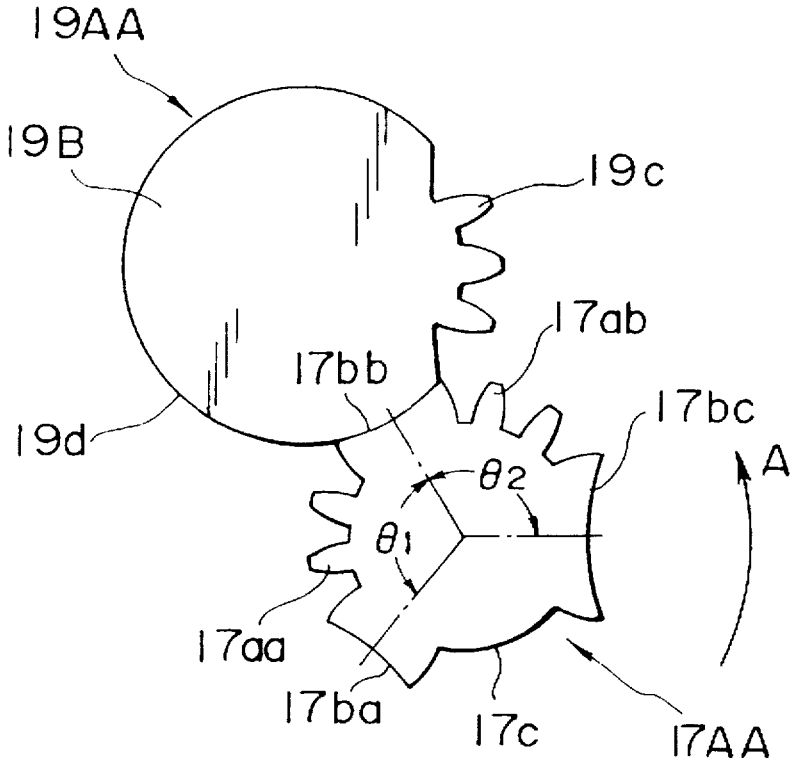
FIG. 14 is a view of explanatory showing a state where the paper-supply roller shown in FIG. 10 is rotated in an idle direction left position.
Figure 15:
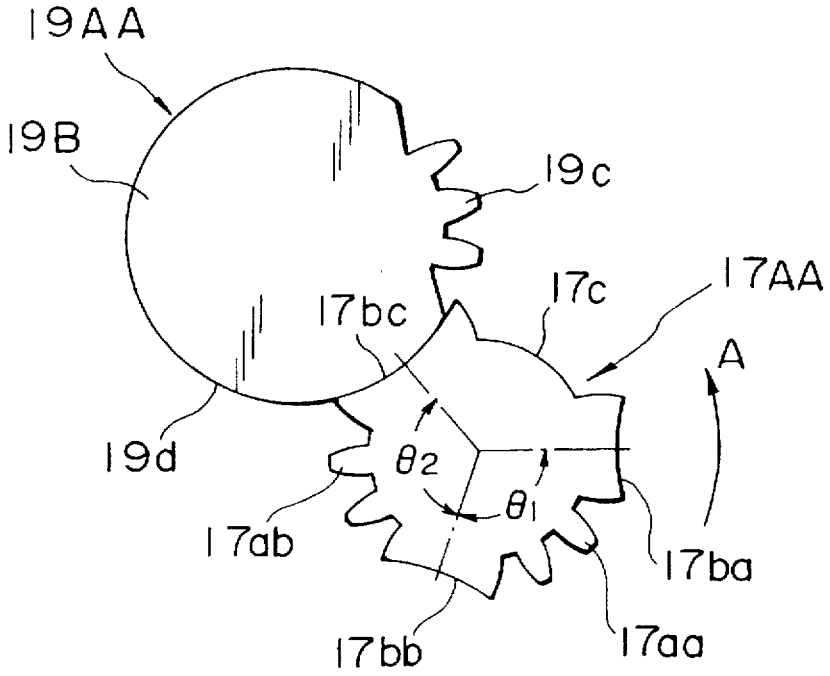
FIG. 15 is a view similar to FIG. 14 and showing a state where the paper-supply roller is rotated in the idle direction at the right position.
Figure 16:
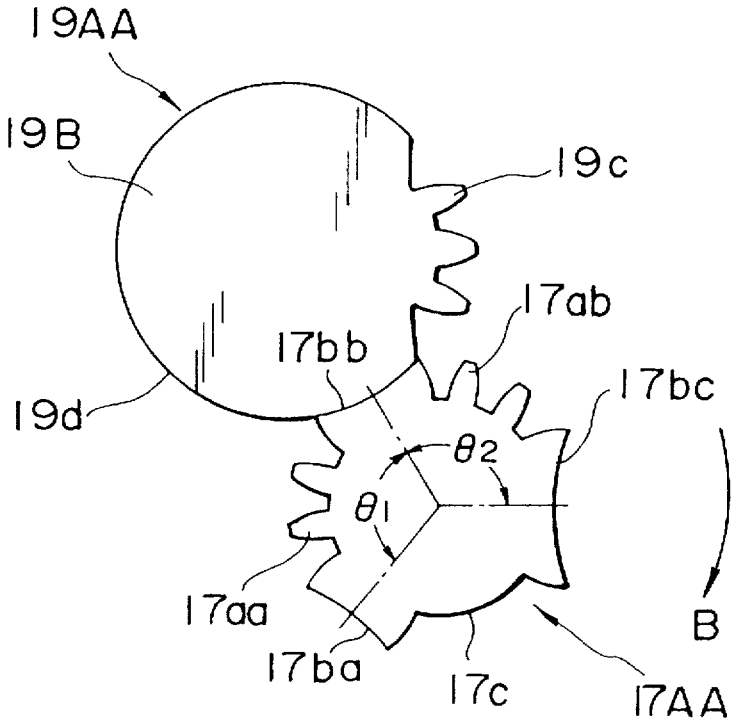
FIG. 16 is a view similar to FIG. 14 and showing a state where the paper-supply roller is rotated in the transmission direction at the right position.

FIGS. 10 to 16 show the modification of the drive-force transmission means for the thermal printer according to the present invention. FIG. 10 is a view of explanatory showing the structure of the drive-force transmission means. FIG. 11 is a partially-enlarged view showing a portion including a roller drive gear. FIG. 12 is a view of explanatory showing the operation of a one-way clutch. FIG. 13 is a view of explanatory showing a roller drive gear. FIG. 14 is a view of explanatory showing a state where a paper-supply roller is idly rotated at the left position. FIG. 15 is a view of explanatory showing a state where the paper-supply roller is idly rotated at the right position. FIG. 16 is a view of explanatory showing a state where the paper-supply roller is rotated in the transmission direction at the right position.

A drive-force transmission means 33A according to this modification has a structure such that an operation for feeding one line is performed by returning 6 ratchets (tooth) of the ratchet of the one-way clutch 18. Moreover, the drive force of the output gear 6 is transmitted to the carriage drive gear 28 through two idle gears 29 and 29A. When the drive force is transmitted to the roller drive shaft 16 through the one-way clutch 18, the quantity of rotation of the roller drive shaft 16 can reliably be made to be the same between a case where the carriage 23 is located at the home position and a case where the carriage 23 is located at a position opposing the home position by structuring a roller drive gear 17AA. The other structures are the same as those of the foregoing drive-force transmission means 33.

The roller drive gear 17AA according to this modification has a structure such that the rotational angle θ1 in the transmission direction indicated by an arrow B shown in FIG. 11 in a case where the carriage 23 is located at the home position is smaller than the rotational angle θ2 in the transmission direction indicated by an arrow B shown in FIG. 10 in the case where the carriage 23 is located at the home position (θ1<θ2). The other structures are substantially the same as those of the foregoing embodiment.

The foregoing structure causes the drive-force transmission means 33A according to this modification to have a similar effect to that obtainable from the foregoing drive-force transmission means 33. Moreover, the quantity of rotation of the roller drive shaft 16 in the case where the carriage 23 is located at the home position and the quantity in the case where the carriage 23 is located at a position opposing the home position can reliably be made to be the same.

The drive-force transmission means 33A according to this modification will now be described further in detail.

As shown in FIG. 10, the drive-force transmission means 33A according to this modification comprises the output gear 6 attached to the output shaft 5*a* of the stepping motor 5; the idle gear 29 engaged to the output gear 6; an idle gear 29A engaged to the idle gear 29 and formed into a two-stepped gear; the carriage drive gear 28 engaged to the idle gear idle gear 29A; a transmission gear 19AA capable of engaging to the carriage drive gear 28; a roller drive gear 17AA capable of engaging to the transmission gear transmission gear 19AA; and the one-way clutch 18 to which the roller drive gear 17AA is attached.

The idle gear 29A has a first gear 29Aa always engaging to the idle gear 29 and formed into a spur-gear-like shape; and a second gear 29Ab formed on the top surface of the first gear 29Aa when viewed in FIG. 10, always engaging to the full face gear 28A of the carriage drive gear 28 and formed into a spur-gear-like shape having a small diameter.

The transmission gear 19AA according to this modification is formed into a two-stepped structure, and as shown in FIGS. 10 and 11 in detail, comprises the first gear 19A capable of engaging to the tooth-decreased gear 28B of the carriage drive gear 28 and formed into a spur-gear-like shape; and a second gear 19B capable of engaging to the roller drive gear 17AA and formed into a spur-gear-like shape. The transmission gear 19AA according to this modification is structured such that when the carriage drive gear 28 is rotated two times, the transmission gear 19AA is rotated once. A tooth portion 19*a* formed on the outer surface of the first gear 19A of the transmission gear 19 has two tooth-omitted portions 19*b* substantially opposing each other. Each of the tooth-omitted portions 19*b* is formed into a concave shape to prevent interference with the tooth-omitted portion 28*b* of the tooth-decreased gear 28B of the carriage drive gear 28. The second gear 19B has a diameter smaller than that of the first gear 19A. The second gear 19B has, on the outer surface thereof, a tooth portion 19*c* consisting of 3 tooth on substantially ¼ circumference thereof. The residual ¾ circumference is formed into a tooth-omitted portion 19*d*. The outer surface of the second gear 19B is located more adjacent to the axial center than the diameter of the bottom of the first gear 19A.

As shown in FIGS. 10 and 11, the roller drive gear 17AA according to this modification has three tooth-omitted portions 17*b* each formed into a concave shape on the outer surface thereof to prevent interference with the tooth-omitted portion 19*d* of the second gear 19B of the transmission gear 19AA. Between a tooth-omitted portion 17*ba* opposing the tooth-omitted portion 19*d* of the second gear 19B of the transmission gear 19AA and shown in a leftwards diagonal upper portion of FIGS. 1 and 10 and a tooth-omitted portion 17*bb* shown in the right portion of FIGS. 10 and 11 and between a tooth-omitted portion 17*bb* shown in the right portion of FIGS. 10 and 11 and a tooth-omitted portion 17*bc* shown in the leftwards diagonal lower portion of FIGS. 10 and 11, there are formed tooth portions 17*aa* and 17*ab* respectively capable of engaging to the tooth portion 19*c* of the second gear 19B of the transmission gear 19AA. Between a tooth-omitted portion 17*ba* opposing the tooth-omitted portion 19*d* of the second gear 19B of the transmission gear 19AA shown in FIG. 11 and the tooth-omitted portion 17*bc* shown in the leftwards diagonal lower portion of FIG. 10, there is formed a tooth-omitted portion 17*c* which does not interfere with the tooth portion 19*c* of the second gear 19B of the transmission gear 19AA. The angle θ1 made between the center of the tooth-omitted portion 17*aa* and the center of the tooth-omitted portion 17*bb* and the angle θ2 made between the center of the tooth-omitted portion 17*bb* and the center of the tooth-omitted portion 17*ab* are made to be different from each other to have a relationship θ1<θ2. The foregoing difference in terms of the angle corresponds to 0.5 teeth of the ratchet of the ratchet gear of the one-way clutch 18.

The characteristic operation of the drive-force transmission means 33*a* according to this modification will now be described further in detail. When the carriage 23 located at the home position is moved to the right as indicated by the arrow D shown in FIG. 9 (in the forward printing direction), the roller drive gear 17AA is rotated counterclockwise (in the idle direction) when viewed in FIG. 11 at a position (the left position) in front of the position, at which the carriage 23 reaches the printable range PA, and a position (the right position), at which the carriage 23 has passed the printable range PA. The counterclockwise rotation of the roller drive gear 17AA causes a driving ratchet 18*a* of the one-way clutch 18 located adjacent to the roller drive gear 17AA to be moved for a distance corresponding to 6 tooth in the direction indicated by an arrow D shown in FIG. 12. Moreover, the ratchet 18*a* goes over a ratchet 18*b* located in the follower portion so that the one-way clutch 18 is idly rotated. The characteristics of the one-way clutch 18 cause the driving ratchet 18*a* located in an initial state indicated by a continuous line of FIG. 13A to be stopped in a state where the driving ratchet 18*a* and the follower ratchet 18*b* substantially engage to each other as indicated by a dashed line of FIG. 13A (total of 6 tooth) when the ratchet 18*a* goes over the follower ratchet 18*b* by 6 tooth and stops at the left position in the forward printing direction. When the carriage 23 moves forwards for printing characters, the roller drive gear 17AA stops at the right position such that it stops at a forward position for a distance corresponding to 6.5 tooth from the start point, at which the roller drive gear 17AA stops at the left position, as indicated by an alternate long and short dash line (total of 12.5 tooth). That is, a play corresponding to 0.5 teeth is provided at the right position.

When the carriage 23 locating to oppose the home position is moved to the left as indicated by the arrow E shown in FIG. 9 (in the return printing direction), the roller drive gear 17AA, at the right position and the left position, rotates clockwise (in the transmission direction) as indicated by the arrow B shown in FIG. 11. The clockwise rotation of the roller drive gear 17AA causes the driving ratchet 18*a* positioned adjacent to the roller drive gear 17AA of the one-way clutch 18 to be engaged to the ratchet 18*b* positioned in the follower position. Thus, the ratchet 18*b* positioned in the follower position to be moved for a distance corresponding to 6 tooth in the direction indicated by the arrow E shown in FIG. 12. Thus, the drive force of the one-way clutch 18 is transmitted to the roller drive shaft 16 by a degree corresponding to the 6 tooth corresponding to one line to be fed.

If the quantity of rotation of the roller drive gear 17AA at the right position and that at the left position are the same, the play of 0.5 teeth in the forward printing direction causes the quantity of rotation of the roller drive shaft 16 to be reduced by a quantity corresponding to the 0.5 teeth at the right position if the ratchet **18*b* located at the follower position is moved for the distance corresponding to the 6 tooth by the ratchet 18*a* located at the driving position. Thus, the driving ratchet 18*a* is stopped while being engaged to the follower ratchet 18*b*. At the left position, the driving ratchet 18*a* starts moving in a state where the driving ratchet 18*a* is engaged to the follower ratchet 18*b***. Therefore, the ratchet located at the follower position is moved for a distance corresponding to the 6 tooth by the driving ratchet when the initial state is restored.

That is, when the rotational force of the roller drive gear 17AA is transmitted to the roller drive shaft 16 through the one-way clutch 18, and if the quantity of rotation (the rotational angle) of the roller drive gear 17AA at the right position and that at the left position are the same, the quantity of rotation (the distance for which the paper is conveyed) of the roller drive shaft 16 at the right position and that at the left position become different by a quantity corresponding to the play at the right position.

Accordingly, the drive-force transmission means 33A according to this modification, the rotational angle θ1 of the roller drive gear 17AA at the left position is determined such that the ratchet **18*b* located at the follower position is able to move for a distance corresponding to the 6 tooth by the ratchet 18*a* located at the driving position. Moreover, the rotational angle θ2 of the roller drive gear 17AA at the right position is determined to be larger by the degree corresponding to the play corresponding to the 0.5 teeth (θ1<θ2). As a result, the quantity of rotation (the distance for which the paper is conveyed) of the roller drive shaft 16** at the right position and that at the left position can reliably be made the same.

By changing the shape of the two tooth-omitted portions **17*b* of the roller drive gear 17 of the drive-force transmission means 33, the quantity of rotation of the roller drive gear 17 at the right position and that at the left position can be made to be different from each other similarly to this modification. Thus, the quantity of rotation (the distance for which the paper is conveyed) of the roller drive shaft 16** can be made to be the same.

FIG. 14 shows a state where the paper-supply roller is idly rotated at the left position. FIG. 15 shows a state where the paper-supply roller is rotated in the idle direction at the right position. FIG. 16 shows a state where the paper-supply roller is rotated in the transmission direction at the right position.

Another modification of the drive-force transmission means of the thermal printer according to the present invention will now be described with reference to FIGS. 17 to 20. The same elements as those of the foregoing embodiment and modification are given the same reference numerals and the same elements are omitted from description.

Figure 17:
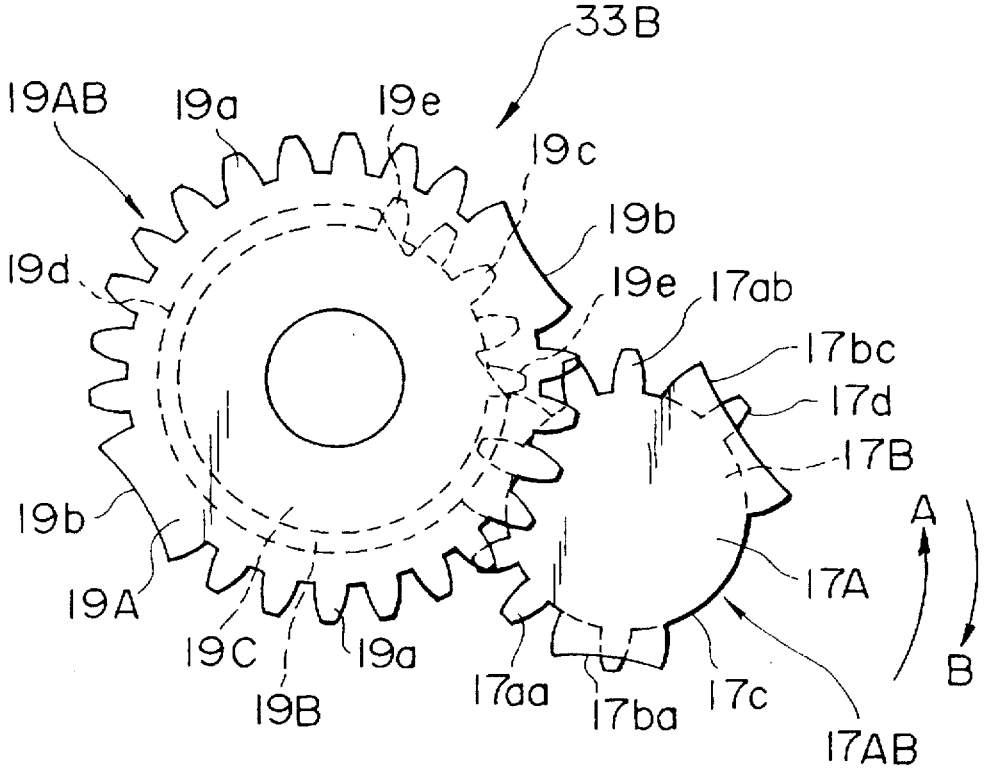
FIG. 17 is a view similar to FIG. 5 and showing the structure of a modification of the drive-force transmission means of the thermal printer according to the present invention.
Figure 18:
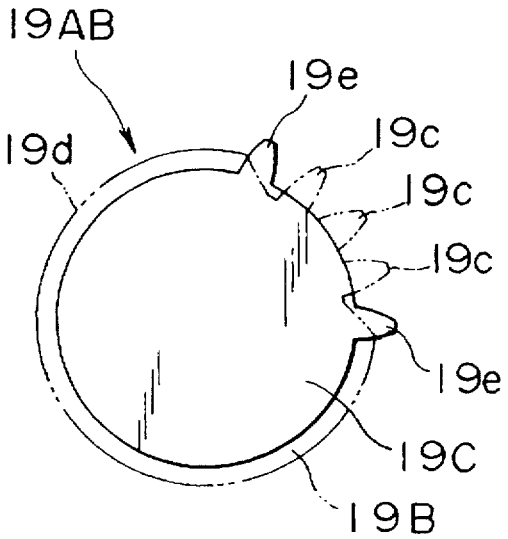
FIG. 18 is a partially enlarged view showing a third gear of the transmission gear shown in FIG. 17.
Figure 19:
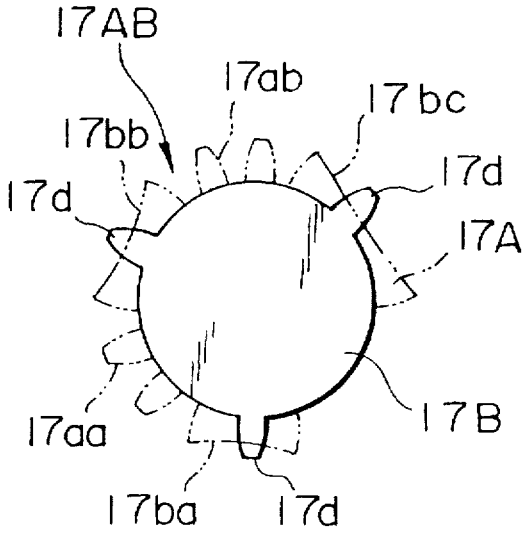
FIG. 19 is a partially enlarged view showing a second gear of the roller drive gear shown in FIG. 17.

FIGS. 17 to 20 show the modification of the drive-force transmission means of the thermal printer according to the present invention. FIG. 17 is a partially enlarged view showing a portion including the roller drive gear. FIG. 18 is a partially enlarged view showing a third gear of the transmission gear. FIG. 19 is a partially enlarged view showing a second gear of the roller drive gear. FIG. 20 is a view of explanatory showing the operation of the drive-force transmission means according to this modification.

The structure of the drive-force transmission means 33B according to this modification is such that transmission of the drive force of a transmission gear 19AB to a roller drive gear 17AB is intended to be smooth.

That is, this modification is arranged such that the transmission gear forming the drive-force transmission means 33B is formed into a three-stepped gear and the roller drive gear 17AB is formed into a two-stepped gear, as shown in FIG. 17.

Each of the first gear 19A and the second gear 19B of the transmission gear 19AB has a similar structure to that of the foregoing transmission gear 19AA (see FIG. 10). As shown in FIG. 18, a third gear 19C below the second gear 19B of the transmission gear 17AB has, thereon, tooth **19*e* to be guided at positions to be located at the outer ends adjacent to the two ends of the tooth portions 19*c* formed on the second gear 19B**.

The first gear 17A of the roller drive gear 17AB has a similar structure to that of the foregoing roller drive gear 17AA (see FIG. 10). The second gear 17B below the first gear 17A of the roller drive gear 17AB is located below each tooth-omitted portion **17*b* provided for the first gear 17A. Moreover, the leading end of the second gear 17B projects over the outer surface of each of the tooth-omitted portions 17*ba*, 17*bb* and 17*bc* and has guide tooth 17*d* capable of engaging to the tooth 19*e* to be guided which is provided for the transmission gear 19AB. The residual structures are similar to those of the foregoing drive-force transmission means 33A**.

As a result of the foregoing structure, the drive-force transmission means 33B according to this modification attains a similar effect to that obtainable from the foregoing drive-force transmission means 33A. Moreover, the transmission of the drive force of the transmission gear 19AB to the roller drive gear 17AB can be performed smoothly.

Figure 20A:
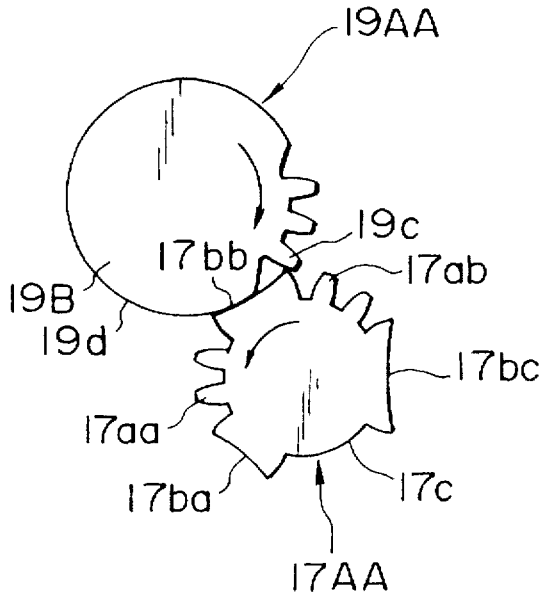
FIGS. 20A, 20B, 20C and 20D are explanatory views showing the operation of the drive-force transmission means shown in FIG. 17.
Figure 20B:
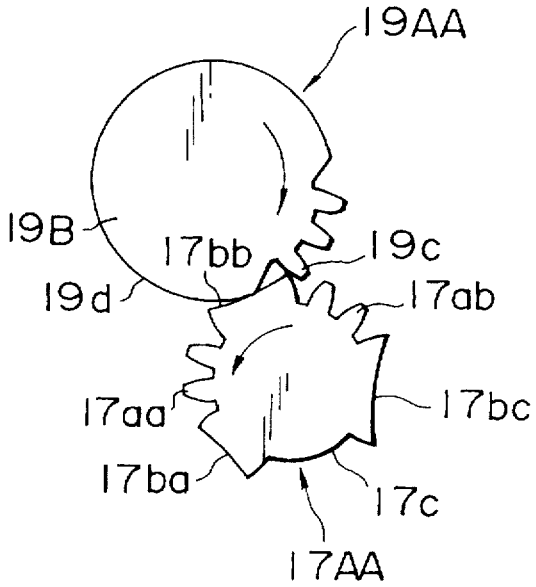
Figure 20C:
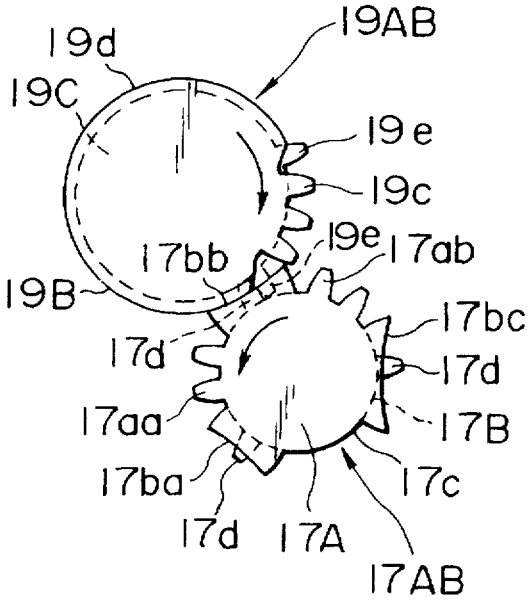
Figure 20D:
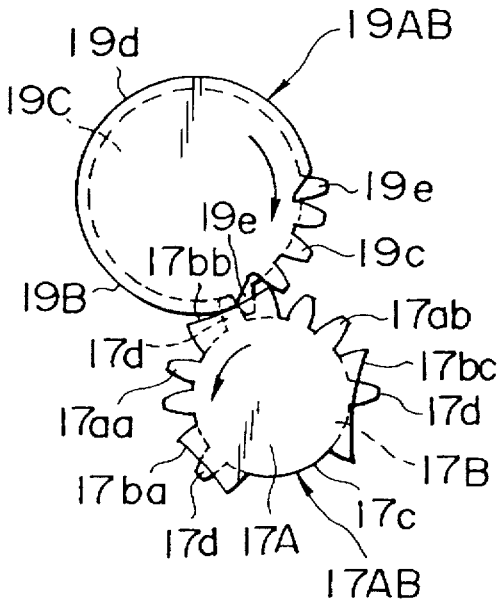

The characteristic operation of the drive-force transmission means 33B according to this modification will now be described further in detail. If the drive force of the transmission gear 19AB is transmitted to the roller drive gear 17AB by a structure in which the tooth **19*e* to be guided and the guide tooth 17*d* are not formed with the structure of the transmission gear 19AA and the roller drive gear 17AA shown in FIG. 10, the tooth portion 19*c* of the transmission gear 19AA and each of the tooth portions 17*aa* and 17*ab* of the roller drive gear 17AA are not engaged to each other discontinuously. Therefore, if the roller drive gear 17AA is intended to be rotated counterclockwise while being loaded, a sharp leading end shown in the upper right portion of FIG. 20A, which shows the transmission gear 19AA, comes in contact with the left side of the tooth portion 19*c* as shown in FIG. 20A, the tooth portion 19*c* being shown in the lower right portion of FIG. 20A, which shows the transmission gear 19AA. Then, as shown in FIG. 20B, the left side of the tooth portion 19*c* is engaged to the right side in the upper right portion of the tooth-omitted portion 17*bb* of the roller drive gear 17AA. Thus, the roller drive gear 17AA is rotated counterclockwise. When the left side of the tooth portion 19*c* of the transmission gear 19AA comes in contact with the leading end of the tooth-omitted portion 17*bb* of the roller drive gear 17AA, impact takes place causing offensive sound to be generated. What is worse, the clockwise rotation of the roller drive gear 17AA** cannot be performed smoothly or breakage takes place.

Accordingly, the drive-force transmission means 33B according to this modification has the structure such that the tooth 19*e* to be guided is provided for the transmission gear 19AB and the guide tooth 17*d* capable of engaging to the tooth 19*e* to be guided is provided for the roller drive gear 19AB so that the transmission gear 19AB and the roller drive gear 19AB are engaged to each other before the left side of the tooth portion 19*c* of the transmission gear 19AB comes in contact with the leading end of the tooth-omitted portion 17*bb* of the roller drive gear AB. Thus, generation of impact noise can be prevented and the transmission of the drive force of the transmission gear 19AB to the roller drive gear 17AB can be performed smoothly.

The tooth 19*e* to be guided and the guide tooth 17*d* attain a similar effect when the roller drive gear 19AB is rotated clockwise.

The present invention is not limited to the description of the foregoing preferred form, and it may be changed as the needs arises.

As described above, the thermal printer according to the present invention enables the movement of the carriage and the rotations of the conveyance rollers to be easily controlled in synchronization with each other by using only one drive motor. Thus, a significant effect can be obtained in that the size and cost of the thermal printer can reliably be reduced.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A thermal printer comprising:

a carriage capable of reciprocatively moving along a platen when a carriage drive shaft is rotated;

a thermal head provided for said carriage to oppose said platen;

an urging member for urging said thermal head to said platen;

a cam portion for separating said thermal head from said platen against the urging force of said urging member when said thermal head has passed a printable range as a result of movement of said carriage;

conveyance rollers to be rotated when a roller drive shaft is rotated and arranged to convey a recording medium;

a drive motor for rotating said carriage drive shaft and said roller drive shaft;

a drive-force transmission means which always transmits the drive force of said drive motor to said carriage drive shaft and which transmits the drive force of said drive motor to said roller drive shaft only when said carriage is moved in either direction and when said thermal head has passed the printable range wherein said drive-force transmission means further includes:

an output gear provided for an output shaft of said drive motor;

a carriage drive gear provided for said carriage drive shaft;

a rotative idle gear capable of always transmitting rotations of said output gear to said carriage drive gear;

a roller drive gear provided for said roller drive shaft through a one-way clutch;

a rotative transmission gear capable of transmitting the drive force of said carriage drive gear to said roller drive gear;

wherein said roller drive gear includes a tooth portion and a tooth-omitted portion structured in such a manner that the quantity of rotation of said roller drive gear is made to be different depending upon the position of said carriage for the purpose of making the quantity of rotation of said roller drive shaft to be the same regardless of the position of said carriage when the drive force of said roller drive gear is transmitted to said roller drive shaft through said one-way clutch.

2. A thermal printer comprising:

a carriage capable of reciprocatively moving along a platen when a carriage drive shaft is rotated;

a thermal head provided for said carriage to oppose said platen;

an urging member for urging said thermal head to said platen;

a cam portion for separating said thermal head from said platen against the urging force of said urging member when said thermal head has passed a printable range as a result of movement of said carriage;

conveyance rollers to be rotated when a roller drive shaft is rotated and arranged to convey a recording medium;

a drive motor for rotating said carriage drive shaft and said roller drive shaft;

a drive-force transmission means which always transmits the drive force of said drive motor to said carriage drive shaft and which transmits the drive force of said drive motor to said roller drive shaft only when said carriage is moved in either direction and when said thermal head has passed the printable range wherein said drive-force transmission means further includes:

an output gear provided for an output shaft of said drive motor;

a carriage drive gear provided for said carriage drive shaft;

a rotative idle gear capable of always transmitting rotations of said output gear to said carriage drive gear;

a roller drive gear provided for said roller drive shaft through a one-way clutch;

a rotative transmission gear capable of transmitting the drive force of said carriage drive gear to said roller drive gear;

wherein said roller drive gear includes a tooth portion and a tooth-omitted portion structured in such a manner that the quantity of rotation of said roller drive gear is made to be different depending upon the position of said carriage for the purpose of making the quantity of rotation of said roller drive shaft to be the same regardless of the position of said carriage when the drive force of said roller drive gear is transmitted to said roller drive shaft through said one-way clutch, wherein said roller drive gear has a guide tooth and a tooth to be guided is provided for said transmission gear, said tooth to be guided being capable of engaging to said guide tooth.

3. A thermal printer comprising:

a carriage capable of reciprocatively moving along a platen when a carriage drive shaft is rotated;

a thermal head provided for said carriage to oppose said platen;

an urging member for urging said thermal head to said platen;

a cam portion for separating said thermal head from said platen against the urging force of said urging member when said thermal head has passed a printable range as a result of movement of said carriage;

conveyance rollers to be rotated when a roller drive shaft is rotated and arranged to convey a recording medium;

a drive motor for rotating said carriage drive shaft and said roller drive shaft;

a drive-force transmission means which always transmits the drive force of said drive motor to said carriage drive shaft and which transmits the drive force of said drive motor to said roller drive shaft only when said carriage is moved in either direction and when said thermal head has passed the printable range wherein said drive-force transmission means further includes:

an output gear provided for an output shaft of said drive motor;

a carriage drive gear provided for said carriage drive shaft;

a rotative idle gear capable of always transmitting rotations of said output gear to said carriage drive gear;

a roller drive gear provided for said roller drive shaft through a one-way clutch;

a rotative transmission gear capable of transmitting the drive force of said carriage drive gear to said roller drive gear, wherein said roller drive gear includes a tooth portion and a tooth-omitted portion structured in such a manner that the quantity of rotation of said roller drive gear is made to be different depending upon the position of said carriage for the purpose of making the quantity of rotation of said roller drive shaft to be the same regardless of the position of said carriage when the drive force of said roller drive gear is transmitted to said roller drive shaft through said one-way clutch;

wherein transmission of the drive force of said drive motor to said conveyance rollers is performed after said thermal head has been separated from said platen by said cam portion.

* * * * *